United States Patent [19]

Olmsted

[11] 4,361,232

[45] Nov. 30, 1982

[54] PROTECTIVE CONTAINER

[76] Inventor: John H. Olmsted, 16116 W. El Dorado Dr., New Berlin, Wis. 53151

[21] Appl. No.: 105,075

[22] Filed: Dec. 19, 1979

[51] Int. Cl.[3] ..... B65D 19/00

[52] U.S. Cl. ..... 206/386; 206/446; 206/524.6

[58] Field of Search ..... 206/386, 446, 524.5, 206/524.6, 318, 319, 597, 598, 600, 427, 443

[56] References Cited

U.S. PATENT DOCUMENTS

| | | | |
|---|---|---|---|
| 2,774,474 | 12/1956 | Phillips | 206/386 |
| 3,638,790 | 2/1972 | Schmid et al. | 206/446 |
| 3,904,030 | 9/1975 | Repp et al. | 206/522 |
| 3,999,653 | 12/1976 | Haigh et al. | 206/524.5 |
| 4,136,823 | 1/1976 | Kullberg | 237/8 R |

FOREIGN PATENT DOCUMENTS

| | | | |
|---|---|---|---|
| 6027 | 12/1979 | European Pat. Off. | 206/386 |
| 2631430 | 7/1976 | Fed. Rep. of Germany | 206/386 |
| 2344457 | 11/1977 | France | 206/386 |

*Primary Examiner*—Joseph Man-Fu Moy
*Attorney, Agent, or Firm*—Fred Wiviott

[57] ABSTRACT

A transportable container for hazardous bulk materials which minimizes the risks of accidental spillage, comprising a closed, transportable weatherproof structure, formed by a solid walled pan and an overlapped protective cover, positioned on a pallet and surrounding two or more separate sealed containers of said material.

6 Claims, 1 Drawing Figure

PROTECTIVE CONTAINER

BACKGROUND OF THE INVENTION

Figure 1:
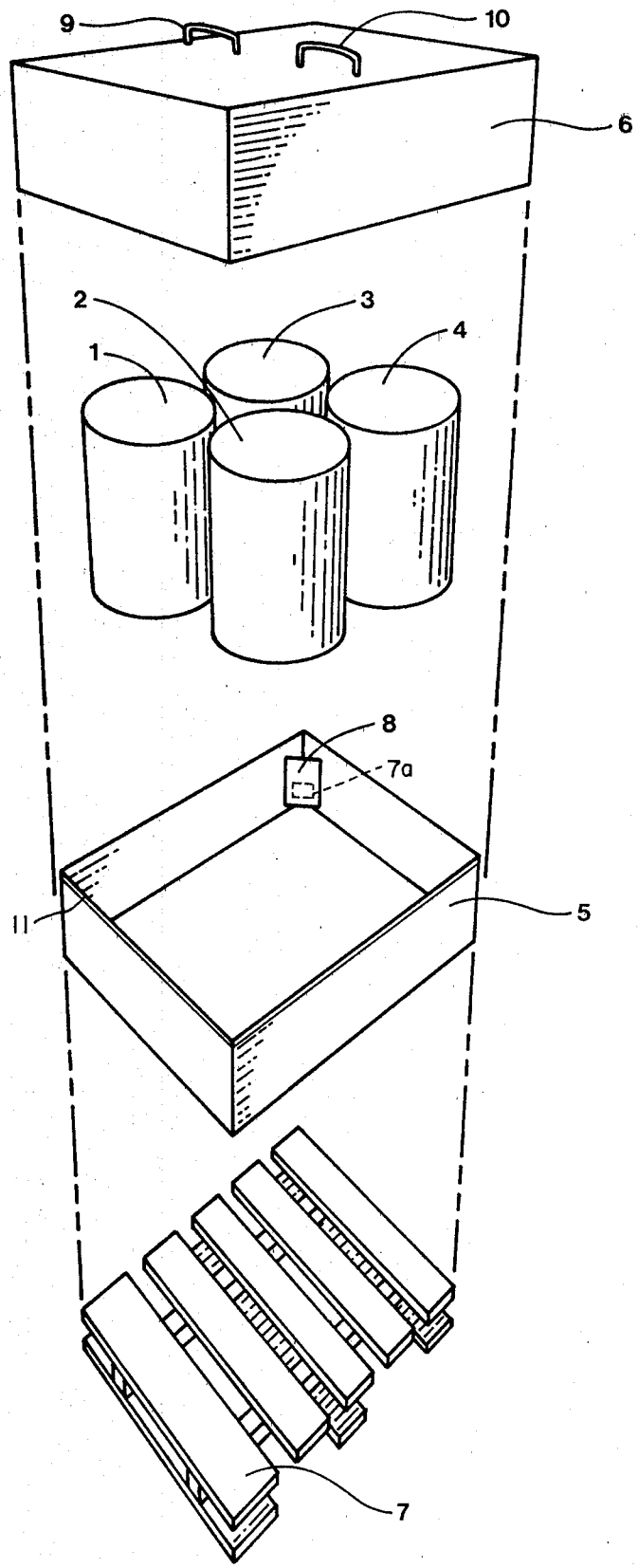

There are many materials in use today which have potentially harmful effects upon the health and safety of personnel or the environment. Heretofor, these materials have been shipped and stored in containers which are designed primarily to protect them from contamination. This condition has resulted in inconvenience and expense to industry in providing the level of monitoring and protection required by the various state and federal agencies.

As example of these conditions is seen in the following abstraction of rules imposed by the U.S. Environmental Protection Agency for the storage of liquids containing more than 500 parts per million of polychlorinated biphenyls (PCBs), intended for disposal. These rules require that the PCB liquids be stored in DOT-17E drums, or equivalant sealed containers, and that those drums be stored in a diked area with an impervious floor without drains. Bulk storage is permitted and does reduce the hazards associated with multiple handling of the material. However, the damage potential of any single accident is increased in direct proportion to the container size. The diked area must contain a volume at least equal to twice the largest container stored therein. The entire area must be protected from weather. Each drum must be monitored for leaks monthly. Additional rules are imposed upon the transportation of these liquids.

SUMMARY OF THE INVENTION

The present invention concerns the construction and use of a container system which provides the needed protection during both storage and transportation of the hazardous materials. This protection is derived from the incorporation of separate sealed containers within a closed, transportable, weatherproof stucture. Thus, physical protection against accidental spillage is continuously provided during storage and transportation to the final use or disposal point.

DRAWING OF THE INVENTION

FIG. 1 is an exploded view in perspective of a protective container according to this invention.

DESCRIPTION OF THE INVENTION

One preferred embodiment of the present invention can be understood by reference to FIG. 1. Four drums, 1, 2, 3, 4, which are the primary containers of hazardous material, are placed in the solid pan,5, prior to filling. Said pan may be constructed by welding steel sheet, but could also be constructed by standard forming methods using any suitable non-porous material; the internal volume of said pan being chosen to exceed twice that of the largest primary container.

A removable solid cover, 6, is placed over the drums and pan, such that it is supported by said drums and its sides extend outside said pan below its upper edge, the extent of over-lap being sufficient to prevent entrance of precipitation.

A separate pallet of conventional construction, 7, is attached under said pan to facilitate movement with a lift truck. It is readily seen that said pallet could have been constructed as an integral part of said pan.

In this embodiment, a suitable liquid level sensor 7*a* of conventional design may be safely located in the space defined by the corner bracket, 8. Up to four such sensors may be utilized for increased protection.

Two lifting handles are provided, 9 and 10, to aid in the removal of the cover. It will be readily understood that said handles are not essential to this invention.

Another embodiment of this invention is obtained by the addition of a flexible seal 11 to the leading edge of either the pan, 5, or the cover, 6, said seal being positioned to close the gap between said pan and said cover, thus providing additional protection against weather and volatilization of said hazardous material.

Still another embodiment of the present invention is obtained by the addition of two or more latches of conventional design to the cover, 6, removably securing said cover to the pan, 5, thus providing additional protection of the primary containers against accidents or physical abuse. It will be readily understood that this same protection is provided by securing said cover to said pan with straps or bands extending around the entire assembly.

It is readily apparent that the present invention provides superior protection from the possible harmful effects of spillage of the hazardous materials stored therin, in that the handling of said material is necessary and that leakage from a primary container is limited in both size and extent during the entire storage and transportation periods. Further, this protection is extended by the present invention to the periods wherein the material is being added or removed from said primary container.

While the subject container has been described in what is presently contemplated as the preferred embodiment thereof, it is understood that changes or modifications of the structure can be made without departing from the spirit or scope of the invention as defined by the following claims.

What is claimed is:

1. The combination of a transportable container and a plurality of primary storage containers disposed therein and each having a generally cylindrical configuration defined by a side wall and a pair of opposite ends, said storage containers being constructed and arranged for containing environmentally hazardous materials, said transportable container including a solid pan having a base for supporting one end of each of said storage containers and a side wall extending upwardly from said base, the volume of said pan as defined by said base and said side wall being at least twice that of any one of said storage containers, the horizontal cross-sectional configuration of said pan being different from that of said storage containers whereby gaps will exist between the sides of said pan and said storage containers to permit the collection of said environmentally hazardous material in said pan should the same leak from said containers, a removable cover receivable on said pan and above the other ends of said containers, said cover having a depending side portion for overlapping the upwardly extending wall of said pan, said cover being supported by resting on said storage containers, said pan and cover being constructed of sheet metal.

2. The combination set forth in claim 1 wherein there is at least one liquid level detector disposed within said pan for detecting the leakage of said environmentally hazardous material from said storage containers and the collection thereon in said pan.

3. The combination set forth in claim 2 wherein the horizontal cross-sectional configurations of said pan and said cover are generally rectangular.

4. The combination set forth in claim 3 wherein a supporting pallet is affixed to the underside of said pan.

5. The combination set forth in claims 2, 3 or 4 and including a flexible seal disposed between the upwardly extending wall of said pan and the depending side of said cover for sealing the interior of said transportable container.

6. The combination set forth in claims 2 or 3 wherein said pan is constructed of sheet metal and said cover is constructed of plastic sheet metal and is supported by resting on said storage containers.

* * * * *